US008453564B1

(12) United States Patent
Merrell

(10) Patent No.: US 8,453,564 B1
(45) Date of Patent: Jun. 4, 2013

(54) CONTAINER CRUSHER

(76) Inventor: Robert A. Merrell, Los Fresnos, TX (US)

( * ) Notice: Subject to any disclaimer, the term of this patent is extended or adjusted under 35 U.S.C. 154(b) by 371 days.

(21) Appl. No.: 12/789,864

(22) Filed: May 28, 2010

(51) Int. Cl.
*B30B 9/32* (2006.01)
*B30B 1/12* (2006.01)
*B30B 13/00* (2006.01)

(52) U.S. Cl.
USPC ..... 100/35; 100/233; 100/283; 100/286; 100/293; 100/902

(58) Field of Classification Search
USPC ..... 100/281, 283, 286, 292, 293, 902, 100/35, 233; D15/122, 123
See application file for complete search history.

(56) References Cited

U.S. PATENT DOCUMENTS

| | | | | | |
|---|---|---|---|---|---|
| 1,402,433 | A | * | 1/1922 | Monroe | 100/233 |
| 2,446,898 | A | * | 8/1948 | Alvarez | 100/233 |
| 3,667,386 | A | | 6/1972 | Workman | |
| 3,732,804 | A | | 5/1973 | Moller | |
| 3,988,978 | A | | 11/1976 | Flick | |
| 4,292,891 | A | | 10/1981 | Shelley | |
| 4,323,009 | A | * | 4/1982 | Voigt | 100/240 |
| 4,333,397 | A | | 6/1982 | Modes | |
| D268,761 | S | | 4/1983 | Brown | |
| 4,827,840 | A | * | 5/1989 | Kane | 100/280 |
| D323,171 | S | | 1/1992 | Wittman et al. | |
| 5,138,941 | A | * | 8/1992 | Strauss | 100/349 |
| 5,331,889 | A | | 7/1994 | Bartlett et al. | |
| 5,347,923 | A | | 9/1994 | Villiger | |
| 5,396,838 | A | * | 3/1995 | Casapulla | 100/116 |
| 5,692,436 | A | * | 12/1997 | Pishioneri | 100/137 |
| 5,802,968 | A | * | 9/1998 | Kirschner et al. | 100/233 |

* cited by examiner

*Primary Examiner* — Jimmy T Nguyen
(74) *Attorney, Agent, or Firm* — Montgomery Patent & Design; Robert C. Montgomery

(57) ABSTRACT

An apparatus that crushes beverage cans and similar containers to reduce waste volume in recycling bins comprises two (2) metal platens held when closed by a hinging mechanism that allows one (1) of the platens to be moved away from the other. The surfaces of the platens which face each other are provided with a textured or ribbed surface to prevent the object to be crushed from slipping out from between the closing platens. A first platen is mounted onto a pair of mounting brackets and a second platen is attached onto a pair of moving links. A pair of parallel operating arms is interconnected by a handle and operates the connected hinging mechanism. The hinging mechanism provides a toggle action which generates an adequate force between the platens to crush the containers. When the handle and the hinging mechanism are returned to the starting position, the opening between the platens allows the crushed object to fall out into the recycling bin.

17 Claims, 3 Drawing Sheets

CONTAINER CRUSHER

RELATED APPLICATIONS

The present invention was first described in a notarized Official Record of Invention on Mar. 26, 2009, that is on file at the offices of Montgomery Patent and Design, LLC, the entire disclosures of which are incorporated herein by reference.

FIELD OF THE INVENTION

The present invention relates generally to the recycling of aluminum and plastic drinking containers and the like, and in particular, to a device adapted for the compacting of such recyclable objects in preparation for recycling.

BACKGROUND OF THE INVENTION

As the population increases, and correspondingly, the amount of waste material produced by people in everyday usage increases, the problem of dealing with waste materials becomes more and more important. As a result, there is an ever increasingly focus on efficient waste management processes including the recycling of used materials. Among the most commonly encountered recyclables are plastic and aluminum beverage containers and similar products.

Many processes and programs are in place to allow persons to recycle such materials on a personal residential basis. Common practices include the collection of waste materials in small personal recycling bins for subsequent collection and processing. However, the amount of materials which are recycled is often limited due to the amount of space available for the collection and disposal of these recyclable materials. Many common recycling bins and the like are small and very limited as to the amount of materials which they can contain. As a result, many recyclable materials are often disposed of into trash receptacles rather than being processed through available recycling channels, increasing the amount of waste material in landfills and limiting the reuse of such resources.

Various attempts have been made to provide for the compaction of recyclable materials. Examples of these attempts can be seen by reference to several U.S. patents. U.S. Pat. No. 3,988,978, issued in the name of Flick, describes a beverage can folder which provides mechanical assistance to a user in crushing common aluminum beverage cans with their foot.

U.S. Pat. No. 4,333,397, issued in the name of Modes, describes a can flattening device. The Modes device is particularly suited for individually flattening cylindrical containers prior to disposal.

U.S. Pat. No. 5,347,923, issued in the name of Villiger, describes an apparatus for collapsing containers. The Villiger apparatus provides a "U"-shaped support which contains a container for subsequent pivoting and crushing.

Additionally, ornamental designs for can crushing devices exist, particularly U.S. Pat. Nos. D 268,761 and D 323,171. However, none of these designs are similar to the present invention.

While these devices fulfill their respective, particular objectives, each of these references suffer from one (1) or more of the aforementioned disadvantages. Many such devices are large and unwieldy, making them aesthetically unpleasing and difficult to store or place. Also, many such devices are complicated, reducing their utility in terms of the amount of time required to compact a plurality of objects. Furthermore, many such devices are not adapted to receive a wide range of recyclable objects. In addition, many such devices are not easily operable by a single user, especially one of low physical strength. Accordingly, there exists a need for a container crushing device without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to easily and quickly compact a plurality of recyclable objects prior to disposal in a manner which is comfortable, convenient, and unobtrusive. Thus, the object of the present invention is to solve the aforementioned disadvantages and provide for this need.

To achieve the above objectives, it is an object of the present invention to allow a user to compact a plurality of common recyclable objects such as plastic and aluminum beverage containers.

Another object of the present invention is to provide a means for securing the apparatus onto a structure in a desired location for easy access. The apparatus comprises a pair of mounting brackets which are affixed in a desired location via a plurality of conventional fasteners.

Yet still another object of the present invention is to crush an empty container into a crushed configuration via the interaction of a fixed platen and a moving platen.

Yet still another object of the present invention is to allow a user to easily motion the moving platen via a mechanism which comprises a plurality of parallel links. The mechanism comprises a pair of tension links, a pair of toggle links, and a pair of swing links which are integrally connected via a plurality of pivots. The links are further integrally connected to the platens and brackets via conventional clip angles.

Yet still another object of the present invention is to allow a user to locate the moveable platen into close proximity to the stationary platen via a handle which provides a parallel hinging motion.

Yet still another object of the present invention is to provide mechanical advantage which aids in the crushing of recyclable containers via a reverse orientation of the toggle links.

Yet still another object of the present invention is to receive containers when in an opened state by placing the container into the open space between the platens.

Yet still another object of the present invention is to flatten the container into a crushed configuration by closing the space between the platens when the handle is pulled downward by a user.

Yet still another object of the present invention is to allow a user to release a crushed container by subsequent upward motioning of the handle which opens the space between the platens.

Yet still another object of the present invention is to provide a method of utilizing the device that provides a unique means of mounting the apparatus in a desired location, repeatedly providing a crushing means to a plurality of beverage containers or the like by repeated downward and upward motioning of the handle, and automatically dispensing the crushed containers into a desired location or receiving container by the repeated opening of the platens and subsequent release and falling of the containers from the apparatus.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
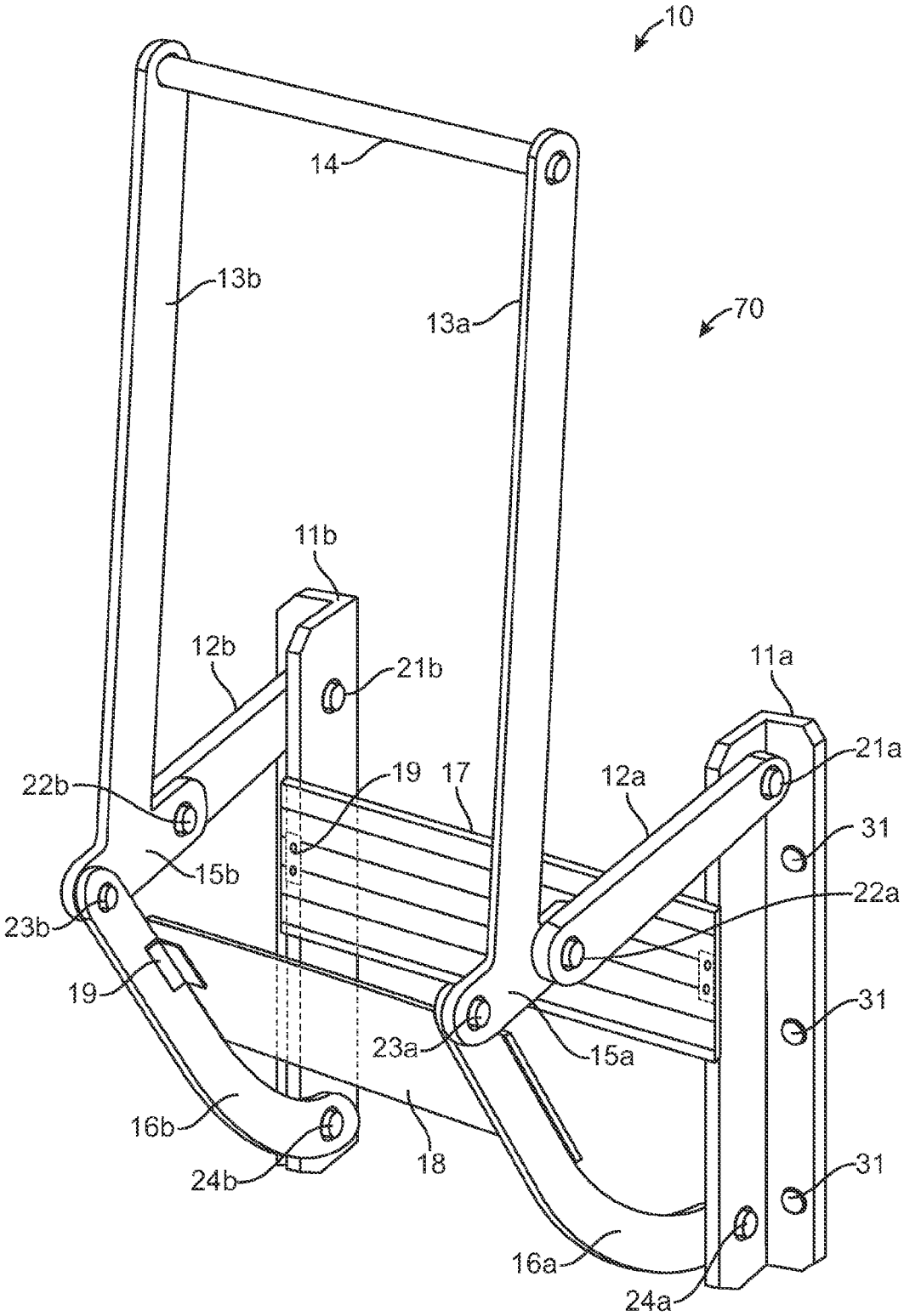
FIG. 1 is a perspective view of a container crusher 10 depicted in an opened state, according to a preferred embodiment of the present invention.

10 container crusher
11*a* first mounting bracket
11*b* second mounting bracket
12*a* first tension link
12*b* second tension link
13*a* first handle bar
13*b* second handle bar
14 handle
15*a* first toggle link
15*b* second toggle link
16*a* first swing link
16*b* second swing link
17 fixed platen
18 moveable platen
19 clip angle
21*a* first pivot
21*b* second pivot
22*a* third pivot
22*b* fourth pivot
23*a* fifth pivot
23*b* sixth pivot
24*a* seventh pivot
24*b* eighth pivot
31 fastener
61 empty container
62 crushed container
63 first direction
64 second direction
65 third direction
66 fourth direction
70 structure

DETAILED DESCRIPTION OF THE PREFERRED EMBODIMENT

The best mode for carrying out the invention is presented in terms of its preferred embodiment, herein depicted within FIGS. 1 through 3C. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a jumper cable system (herein described as the "system") 10, which provides an integral means for cleaning battery terminals and grounded jumper connections.

The present invention describes a container crusher (herein described as the "apparatus") 10, which provides a means for crushing empty container hereinto a space saving disposal or recycling configuration.

Referring now to FIG. 1, a perspective view of the apparatus 10 depicted in an opened state, according to the preferred embodiment of the present invention, is disclosed. The apparatus 10 comprises a first mounting bracket 11*a* and a second mounting bracket 11*b*. These brackets 11*a* and 11*b* provide a means for securing the apparatus 10 onto a structure 70 by using of a plurality of fasteners 31 such as: lag screws, toggle bolts, masonry screws or wood screws, depending on the materials comprising the structure 70. The crushing of an empty container 61 into a configuration of a crushed container 62 is achieved by the interaction of a fixed platen 17 and a moving platen 18. The action of the moving platen 18 is achieved by a mechanism consisting of a plurality of parallel links comprising a first tension link 12*a* and a second tension link 12*b*, a first toggle link 15*a* and a second toggle 15*b*, and a first swing link 16*a*, and a second swing link 16*b*. The first toggle link 15*a* is an integral member of the bottom portion of the first handle bar 13*a* and the second toggle link 15*b* is an integral member of the bottom portion of the second handle bar 13*b*. The top portion of the first handle bar 13*a* is joined therewith the top portion of the second handle bar 13*b* by a handle 14, thereby achieving a parallel assembly. One (1) end of the fixed platen 17 is fastened onto a face portion of the first mounting bracket 11*a*, while the opposite end of the fixed platen 17 is fastened onto a corresponding face portion of the second mounting bracket 11*b* by means a pair of clip angles 19. One (1) end portion of the moveable platen 18 is fastened onto an edge portion of the first swing link 16*a* while the opposite end portion of the moveable platen 18 is fastened onto an edge portion of the second swing link 16*b* by means of a pair of clip angles 19. The permanent connections between one (1) leg of the clip angles 19 and the platens 17 and 18 and between the opposite leg of the clip angles 19 and the mounting brackets 11*a* and 11*b* or the swing links 16*a* and 16*b* can be achieved by means such as: screws, bolts, rivets, adhesive bonding, or welding. The platens 17 and 18 are envisioned to be made of materials such as: steel, aluminum, hard wood, or a plastic of suitable strength, and that the interior surface portions facing each other are textured or ribbed thereby preventing the container 61 of escaping during the progress of the crushing operation. The mounting brackets 11*a*, 11*b*, the handle bars 13*a*, 13*b*, and the links 12*a*, 12*b*, 15*a*, 15*b*, 16*a* and 16*b* are envisioned to be made of materials similar to those of the platens.

Figure 2:
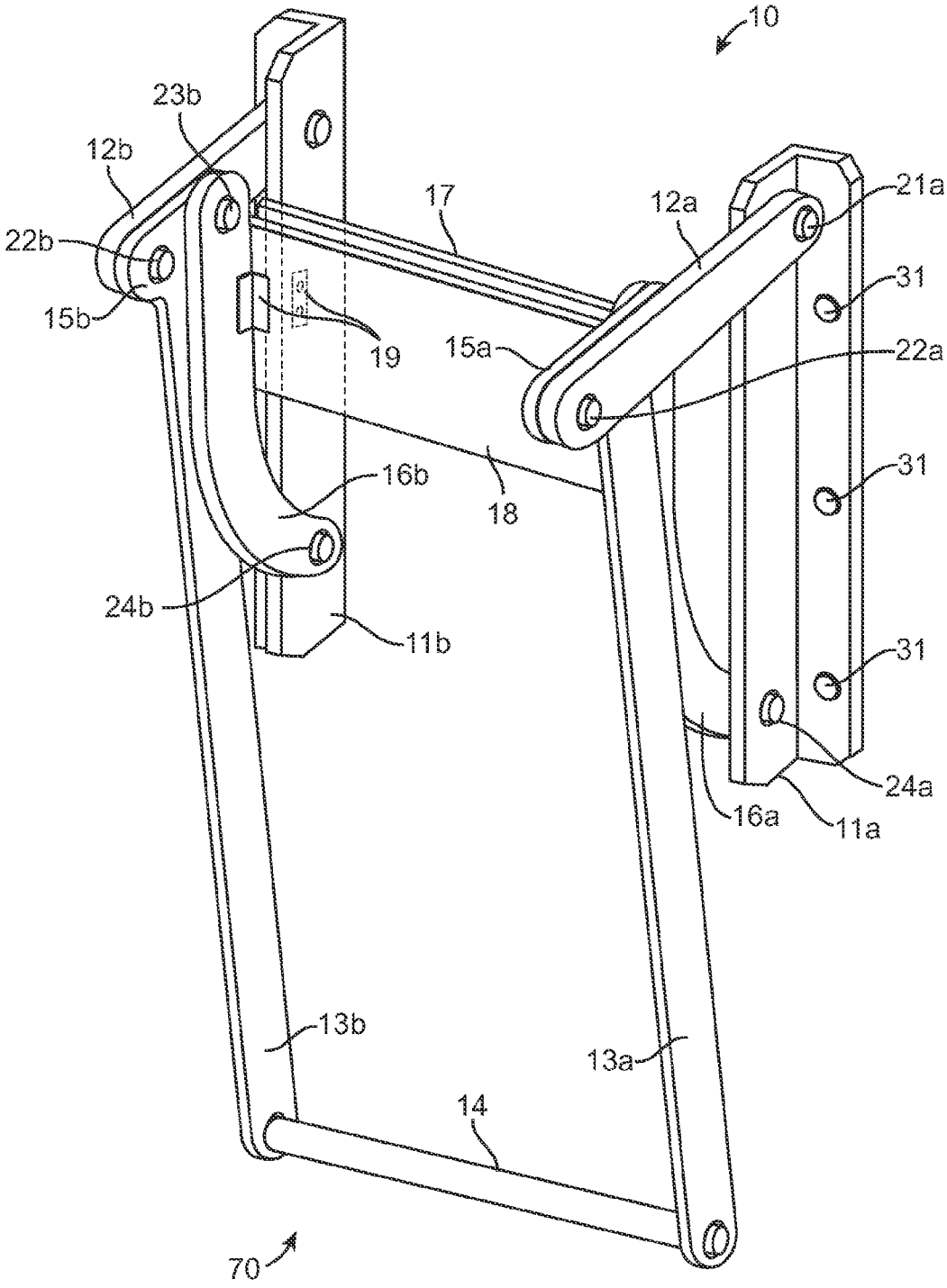
FIG. 2 is a perspective view of the container crusher 10 depicted in a closed state, according to the preferred embodiment of the present invention.

Referring now to FIG. 2, a perspective view of the apparatus 10 depicted in a closed state, according to the preferred embodiment of the present invention, is disclosed. The apparatus 10 comprises a first pivot 21*a*, a corresponding second pivot 21*b*, a third pivot 22*a*, a corresponding fourth pivot 22*b*, a fifth pivot 23*a*, a corresponding sixth pivot 23*b*, a seventh pivot 24*a*, and a corresponding eight pivot 24*b*. The first pivot

21*a* pivotally connects a first end of the first tension link 12*a* onto the first mounting bracket 11*a* and the third pivot 22*a* pivotally connects a second end of the first tension link 12*a* onto a first end of the first toggle link 15*a*. The second pivot 21*b* pivotally connects s first end of the second tension link 12*b* onto the second mounting bracket 11*b* and the fourth pivot 22*b* pivotally connects a second end of the first tension link 12*a* onto a first end of the second toggle link 15*b*. The fifth pivot 23*a* pivotally connects a second end of the first toggle link 15*a* onto a first end of the first swing link 16*a* and the seventh pivot 24*a* pivotally connects a second end of the first swing link 16*a* onto a bottom portion of the first mounting bracket 11*a*. The sixth pivot 23*b* pivotally connects a second end of the second toggle link 15*b* onto a first end of the second swing link 16*b* and the eighth pivot 24*b* pivotally connects a second end of the second swing link 16*b* onto a bottom portion of the second mounting bracket 11*b*. The assembly of the handle bars 13*a* and 13*b* and of the links 12*a*, 12*b*, 15*a* and 15*b*, 16*a* and 16 provide a parallel hinging mechanism. Moving the handle 14 from an upward position depicted within FIG. 1 into a downward position depicted within FIG. 2 reverses the orientation of the pair of toggle links 15*a* and 15*b* and causes the swing links 16*a* and 16*b* to locate the moveable platen 18 into a close proximity to the stationary platen 18, thereby flattening the container 61 hereinto the configuration of the crushed container 62. The reversal in the orientation of the toggle links 15*a* and 15*b* results in a mechanical advantage needed to achieve the crushing of recyclable metal and plastic containers which includes, but is not limited to: beverage cans, food cans, and various fruit and liquid containers.

Figure 3A:
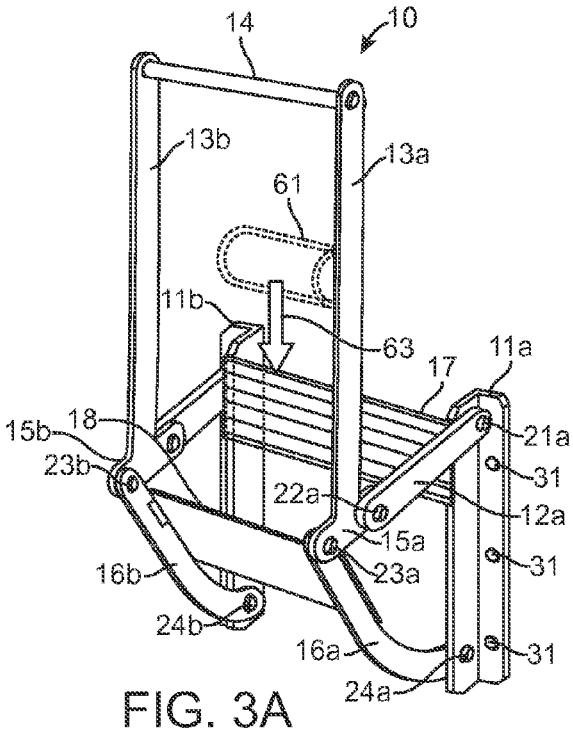
FIG. 3A is a perspective environmental view of the container crusher 10 depicted in the open state and receiving an empty container 61, according to the preferred embodiment of the present invention.

Referring now to FIG. 3A, a perspective environmental view of the apparatus 10 depicted in an opened state of receiving and empty container 61, according to the preferred embodiment of the present invention, is disclosed. The apparatus comprises the assembly of the parallel handle bars 13*a* and 13*b* and the handle 14 depicted in an upward orientation. The container 61 is depicted being dropped into the open space between the pair of platens 17 and 18 by the first direction 63.

Figure 3B:
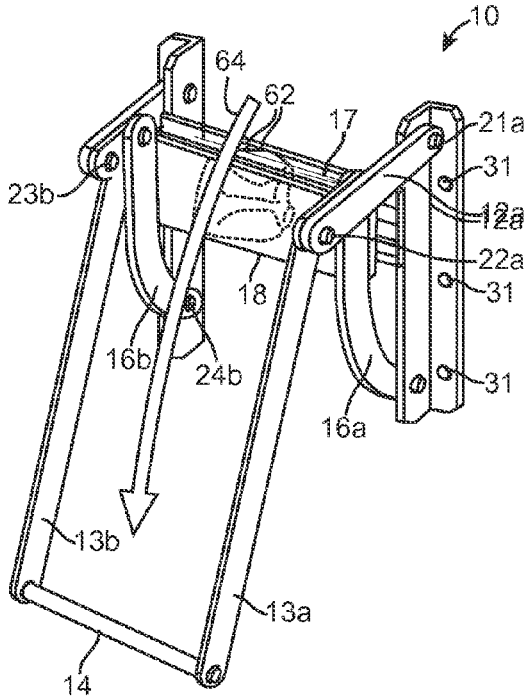
FIG. 3B is a perspective environmental view of the container crusher 10 depicted in the closed state, thereby producing a crushed container 62, according to the pre-ferred embodiment of the present invention; and, FIG. 3C is a perspective environmental view of the container crusher 10 depicted in the re-opened state and having released the crushed container 62, according to the preferred embodiment of the present invention.

Referring now to FIG. 3B, a perspective environmental view of the apparatus 10 depicted in a closed state and of having flattened the container 61, according to the preferred embodiment of the present invention, is disclosed. Moving the assembly of the parallel handle bars 13*a* and 13*b* and the handle 14 downwardly in the second direction 64 closes the space between the platens 17 and 18 thereby flattening the container 61 into the crushed container 62 configuration.

Figure 3C:
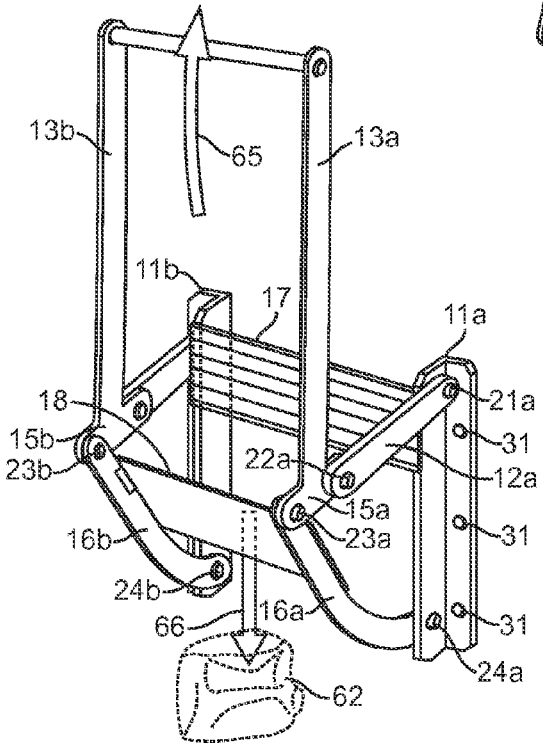

Referring now to FIG. 3C, a perspective environmental view of the apparatus 10 depicted in a re-opened state, according to the preferred embodiment of the present invention, is disclosed. The assembly of the parallel handle bars 13*a* and 13*b* and the handle 14 have been moved along a third direction 65, thereby returning the apparatus 10 to the initial upward orientation. The crushed container 62 is depicted being released from between the pair of platens 17 and 18 along the fourth direction 66.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: unpacking the apparatus 10; keeping the apparatus 10 into the closed state; selecting a desired mounting location and height on a structure 70; marking a pattern for the fasteners 31 onto the structure 70; drilling the appropriate apertures for mounting the fasteners 31; procuring a temporary means of safely supporting the apparatus 10; installing the supporting means at the selected location; securing the apparatus 10 onto the supporting means; fastening the apparatus 10 onto the structure 17 by installing the fasteners 31 through the apertures within the mounting brackets 11*a* and 11*b*; securing the apparatus 10 onto the structure 70 by tightening the fasteners 31; testing the function of the apparatus 10 by moving the handle 14 upwardly and downwardly; installing a recycling bin under the apparatus 10; opening the apparatus 10 by moving the handle 14 to its raised position; dropping an empty container 61 into the open space between the pair of platens 17 and 18; swinging the handle 14 downward to is lowered position to produce the flattened container 62; re-opening the apparatus 10 by returning the handle 14 to its initial upward position; allowing the crushed container 62 to drop from the open space between the pair of platens 17 and 18 into the recycling bin; repeating the crushing cycle until the entire supply of empty containers 61 has been crushed; removing the recycling bin containing bin containing the crushed containers 62; and, cleaning and closing the apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A container crusher for manually crushing containers, said container crusher comprising:

first and second mounting brackets;

a fixed platen fastened to said first and second mounting brackets via a first set of clip angles;

a pair of upper links attached to said first and second mounting brackets via a first and a second pivot, respectively;

a pair of curvilinear lower links each attached to said first and second mounting brackets, respectively;

a moving platen attached to said lower links via a second set of clip angles;

a pair of handle bars each having an integral toggle link pivotally attached to one of said upper links via a third and a fourth pivot, respectively, and to one of said lower links via a fifth and a sixth pivot, respectively;

said pair of curvilinear lower links each attached to said first and second mounting brackets via a seventh and an eighth pivot, respectively; and, a handle attached to said handle bars;

wherein movement of said handle between upward and downward positions locates said moving platen away and toward said fixed platen respectively.

2. The container crusher of claim 1, wherein movement of said handle to said upward position creates an open space between interior surface portions of said fixed and moving platens; and, wherein downward movement of said handle closes said open space between said fixed and moving platens.

3. The container crusher of claim 1, wherein movement of said handle from said upward position to said downward position locates said moving platen to a close proximity to said stationary platen.

4. The container crusher of claim 1, wherein:

said upper links comprise first and second tension links spaced apart at a parallel orientation;

said toggle links comprise first and second toggle links spaced apart at a parallel orientation; and, said lower links comprise first and second swing links spaced apart at a parallel orientation;

wherein a first end portion of said moving platen is fastened onto one edge portion of said first swing link while a second end portion of said moving platen is fastened onto another edge portion of said second swing link.

5. The container crusher of claim 4, wherein:

said first pivot pivotally connects a first end of said first tension link onto said first mounting bracket; and, said second pivot pivotally connects a first end of said second tension link onto said second mounting bracket.

6. The container crusher of claim 5, wherein:

said third pivot pivotally connects a second end of said first tension link onto a first end of said first toggle link; and, said fourth pivot pivotally connects a second end of said first tension link onto a first end of said second toggle link.

7. The container crusher of claim 6, wherein:

said fifth pivot pivotally connects a second end of said first toggle link onto a first end of said first swing link; and, said sixth pivot pivotally connects a second end of said second toggle link onto a first end of said second swing link.

8. The container crusher of claim 7, wherein:

said seventh pivot pivotally connects a second end of said first swing link onto a bottom portion of said first mounting bracket respectively; and, said eighth pivot pivotally connects a second end of said second swing link onto a bottom portion of said second mounting bracket.

9. A container crusher for manually crushing containers, said container crusher comprising:

first and second mounting brackets maintained at a fixed position;

a fixed platen fastened to said first and second mounting brackets via a first set of clip angles;

a pair of upper links pivotally attached to said first and second mounting brackets via a first and a second pivot, respectively;

a pair of curvilinear lower links each attached to said first and second mounting brackets, respectively;

a moving platen attached to said lower links via a second set of clip angles;

a pair of handle bars each having an integral toggle link pivotally attached to one of said upper links via a third pivot and a fourth pivot, respectively, and to one of said lower links via a fifth pivot and a sixth pivot, respectively;

said pair of curvilinear lower links each attached to said first and second mounting brackets via a seventh pivot and an eighth pivot, respectively; and, a handle attached to said handle bars;

wherein movement of said handle between upward and downward positions locates said moving platen away and toward said fixed platen respectively.

10. The container crusher of claim 9, wherein movement of said handle to said upward position creates an open space between interior surface portions of said fixed and moving platens; and, wherein downward movement of said handle closes said open space between said fixed and moving platens.

11. The container crusher of claim 9, wherein movement of said handle from said upward position to said downward position locates said moving platen to a close proximity to said stationary platen.

12. The container crusher of claim 9, wherein:

said upper links comprise first and second tension links spaced apart at a parallel orientation;

said toggle links comprise first and second toggle links spaced apart at a parallel orientation; and, said lower links comprise first and second swing links spaced apart at a parallel orientation;

wherein a first end portion of said moving platen is fastened onto one edge portion of said first swing link while a second end portion of said moving platen is fastened onto another edge portion of said second swing link.

13. The container crusher of claim 12, wherein:

said first pivot pivotally connects a first end of said first tension link onto said first mounting bracket; and, said second pivot pivotally connects a first end of said second tension link onto said second mounting bracket.

14. The container crusher of claim 13, wherein:

said third pivot pivotally connects a second end of said first tension link onto a first end of said first toggle link; and, said fourth pivot pivotally connects a second end of said first tension link onto a first end of said second toggle link.

15. The container crusher of claim 14, wherein:

said fifth pivot pivotally connects a second end of said first toggle link onto a first end of said first swing link; and, said sixth pivot pivotally connects a second end of said second toggle link onto a first end of said second swing link.

16. The container crusher of claim 15, wherein:

said seventh pivot pivotally connects a second end of said first swing link onto a bottom portion of said first mounting bracket respectively; and, said eighth pivot pivotally connects a second end of said second swing link onto a bottom portion of said second mounting bracket.

17. A method of utilizing container crusher for manually crushing containers, said method comprising the steps of:

providing and maintaining first and second mounting brackets at a fixed position;

providing and attaching a first plurality of clip angles to said first and second mounting brackets;

providing and fastening a fixed platen to said first and second mounting brackets via said first plurality of clip angles;

providing and pivotally attaching each of a pair of upper links to one of said first and second mounting brackets;

providing and pivotally attaching each of a pair of curvilinear lower links to one of said first and second mounting brackets;

providing and attaching a moving platen to said lower links via a second plurality of clip angles;

providing and pivotally attaching each of a pair of handle bars to one of said upper links via an integral toggle link and to one of said lower links via the integral toggle link;

providing and attaching a handle to said handle bars; and, locating said moving platen away and toward said fixed platen by respectively moving said handle between upward and downward positions.

* * * * *